US008996279B2

(12) United States Patent
Dobeck et al.

(10) Patent No.: US 8,996,279 B2
(45) Date of Patent: Mar. 31, 2015

(54) METHOD AND SYSTEM FOR OPTIMIZING FUEL DELIVERY TO A FUEL INJECTED ENGINE OPERATING IN POWER MODE

(76) Inventors: Michael V. Dobeck, Henderson, NV (US); Andrew M. MacDonald, Las Vegas, NV (US)

( * ) Notice: Subject to any disclaimer, the term of this patent is extended or adjusted under 35 U.S.C. 154(b) by 895 days.

(21) Appl. No.: 13/212,435

(22) Filed: Aug. 18, 2011

(65) Prior Publication Data

US 2012/0065867 A1 Mar. 15, 2012

Related U.S. Application Data

(60) Provisional application No. 61/375,430, filed on Aug. 20, 2010.

(51) Int. Cl.
*F02D 41/30* (2006.01)
*F02D 41/26* (2006.01)

(52) U.S. Cl.
CPC ..... *F02D 41/266* (2013.01); *F02D 41/30* (2013.01); *F02D 2200/101* (2013.01); *F02D 2400/11* (2013.01)
USPC ..... 701/103

(58) Field of Classification Search
CPC ... F02D 41/30; F02D 41/266; F02D 2400/11; F02D 2200/101
USPC ..... 701/103, 104; 123/478
See application file for complete search history.

(56) References Cited

U.S. PATENT DOCUMENTS 2,628,606 A 2/1953 Draper et al.
3,142,967 A 8/1964 Schweitzer
4,368,707 A 1/1983 Leshner et al.
4,727,836 A * 3/1988 Oshizawa et al. ..... 123/357
4,982,709 A 1/1991 Oota
5,195,497 A 3/1993 Yoshida et al.
5,253,631 A 10/1993 Curran
5,255,661 A 10/1993 Nankeen et al.
5,335,637 A 8/1994 Davis et al.
5,365,917 A 11/1994 Adams et al.
5,467,755 A 11/1995 Konrad et al.
5,868,117 A 2/1999 Moote et al.
5,881,703 A 3/1999 Nankeen et al.
5,937,798 A 8/1999 Cheng et al.
5,950,599 A 9/1999 Rotramel et al.
6,704,640 B2 * 3/2004 Miki ..... 701/104
6,834,641 B2 12/2004 Watanabe
7,305,939 B2 12/2007 Carlson
7,404,397 B2 7/2008 Dobeck
7,996,146 B2 * 8/2011 Ruiz ..... 701/104
8,463,527 B2 * 6/2013 Thorsen et al. ..... 701/103
2002/0173902 A1 * 11/2002 Haimerl et al. ..... 701/115
2003/0139872 A1 * 7/2003 Miki ..... 701/104
2003/0187567 A1 10/2003 Sulatisky et al.

(Continued)

*Primary Examiner* — Hieu T Vo
*Assistant Examiner* — Arnold Castro
(74) *Attorney, Agent, or Firm* — Weide & Miller, Ltd.

(57) ABSTRACT

A method and system are provided for optimizing fuel delivery to an internal combustion engine. The method and system have particular applicability to an engine having a base or OEM engine control unit (ECU) which outputs fuel injector control signals. In accordance with the method, when the engine is operating in one or more modes, such as a Power Mode, the amount of fuel delivered to the engine is modified, such as by changing the duration of the fuel injector control signals with a secondary ECU. The control signals are modified based on engine speed, and thus in direct relation to engine performance.

11 Claims, 5 Drawing Sheets

(56) References Cited

U.S. PATENT DOCUMENTS

2005/0273246 A1 12/2005 Griese
2006/0016435 A1* 1/2006 Kirkpatrick ..... 123/490
2008/0140280 A1* 6/2008 Kerejewski et al. ..... 701/31
2008/0255753 A1* 10/2008 Spivak ..... 701/103
2008/0300768 A1* 12/2008 Hijikata ..... 701/102
2009/0055080 A1* 2/2009 Kronenberg et al. ..... 701/103
2009/0198435 A1* 8/2009 Baumann et al. ..... 701/103

* cited by examiner

METHOD AND SYSTEM FOR OPTIMIZING FUEL DELIVERY TO A FUEL INJECTED ENGINE OPERATING IN POWER MODE

RELATED APPLICATION DATA

This application claims priority to U.S. Provisional Application Ser. No. 61/375,430, filed Aug. 20, 2010.

FIELD OF THE INVENTION

The present invention relates to methods and devices for controlling the rate of delivery of fuel to an internal combustion engine.

BACKGROUND OF THE INVENTION

The overall adaptability, functionality and viability of an internal combustion engine is dependent upon the ability to precisely provide the correct air/fuel ("A/F") ratio that is best suited for the varying operating conditions of the engine. The current state of the art of engine fuel management comprises various forms of computer controlled electronic fuel injection systems. While the use of fuel injection systems generally results in improved engine performance as a result of better A/F mixing and control (such as compared to carbureted engines), the development of computer controlled fuel injection and its almost universal use was driven by the need to comply with the increasingly more stringent exhaust emissions regulations. In particular, such computer controlled engine management systems are designed to constantly monitor and adapt to changing conditions to maintain emissions compliance.

The most common engine control systems are closed loop systems that continuously alter the amount of fuel delivered to the engine based on the output of sensors that directly monitor engine exhaust. In such systems, a specific sensor output value is selected that complies with emissions, and then the quantity of fuel which is delivered to the engine is increased or decreased in an effort to maintain engine exhaust with a sensed output near the selected value. In such a configuration, the engine is controlled so that it operates in a manner which complies with emissions requirements, and not necessarily in a manner which maximizes engine performance (such as engine power output).

Current emission regulations focus on normal vehicle street operations within legal speed limits and under conditions of low to moderate acceleration. This is because the engine A/F ratios that correspond to engine exhaust levels which meet emissions requirements are generally not those A/F ratios which are required to operate the engine in a high power output range or "Power Mode." An engine may be run in Power Mode, for example, when a vehicle is passing, climbing hills, towing or under other situations of heavy acceleration or heavy load. Because of this, engines are generally required to meet emissions requirements under normal operating requirements and not in Power Mode. As such, the engine control systems of most vehicles only utilize a closed loop fuel control mode during normal engine operating mode and not during operation of the engine in Power Mode. During Power Mode operation, the A/F ratios are controlled by a preprogrammed set of fuel maps and mathematical formulas and fuel delivery is not controlled to maintain specified emissions levels as monitored by the sensors, but rather is controlled in an "open loop". Commonly this manner of engine control is referred to as closed-loop during the emissions mode and open-loop during Power Mode.

In such a configuration, engine performance can be enhanced during operation in Power Mode because the engine's operation is not controlled so as to meet emission regulations. On the other hand, the engine's performance is still not optimized because during Power Mode the A/F ratio is determined from the fuel maps. The operation of a particular engine at a particular time may not closely match the conditions which were used to generate the fuel tables. In this regard, the open-loop operation of the engine during Power Mode does not ensure that the engine control is varied based upon operating conditions to maximize engine performance.

The automotive and motorsports aftermarket industry provides consumers with a large variety intake, exhaust or other engine modification products for the purpose of increasing engine performance. A problem with these modification products is that optimal gains can often only be realized with associated modifications to the OEM fuel delivery system. In particular, when a consumer makes an engine modification, such as a modification to the intake or exhaust system that goes beyond the OEM fuel system parameters, performance and functionality of the engine can suffer if associated changes are not made to the engine control system. As a result, in order to obtain maximum gains, consumers may be forced to modify either specific sensor outputs (thus affecting a bias to the stock fuel map or devices that directly modify the stock fuel pulse width), replace the OEM engine controller or entirely re-program the controller so that it works with the modified engine.

In one arrangement, a consumer may attempt to increase engine performance by modifying the engine so that it operates in a closed-loop condition during Power Mode, rather than being controlled in an open-mode based upon fuel tables and with no regard to actual engine conditions. For example, a consumer may install modified or additional sensors, such a wide band oxygen sensor or an air mass sensor or both, so that the engine may be operated continuously in a closed-loop arrangement (including during Power Mode). The output of these sensors may be utilized to provide additional or modified control signals by the OEM engine controller. These modified signals may be used to target both operation of the engine in emissions mode operation and in Power Mode operation.

However, such a modification has various drawbacks. Among them is that the consumer must install and use of one more secondary sensors. These sensors can themselves be expensive and they can be expensive to install and maintain. In addition, such a modified control arrangement still controls fuel delivery based upon feedback from sensors which measure secondary engine variables such as air flow or exhaust, rather than direct reference to actual engine power or performance.

SUMMARY OF THE INVENTION

One aspect of the invention is a method and system for optimizing fuel delivery to an internal combustion engine. In a preferred embodiment, when an engine is operating at one or more detected or predetermined conditions, a base fuel delivery amount is modified.

In one embodiment of the method, a base fuel delivery amount is either increased or decreased by a modifier value, resulting in a modified actual fuel delivery amount. The base fuel delivery amount may be represented as the duration of a fuel injector control signal and the modifier value may comprise a time duration which either increases or decreases the duration of the base signal.

In a preferred embodiment, the amount of fuel delivered to the engine is then further modified based upon feedback. Preferably, this feedback comprises a determination of whether the speed of the engine has increased or decreased, such as determined by comparing the time duration of adjacent time cycles of one or more features of the engine (where the time of those cycles is directly related to the operating speed of the engine).

If the modifier value increased the amount of fuel delivered to the engine and the engine speed increased, then the amount of fuel delivered to the engine is further increased by an additional modifier. If the modifier value increased the amount of fuel delivered to the engine and the engine speed decreased, then the amount of fuel delivered to the engine is decreased by an additional modifier. If the modifier value decreased the amount of fuel delivered to the engine and the engine speed increased, then the amount of fuel delivered to the engine is further decreased by an additional modifier. If the modifier value decreased the amount of fuel delivered to the engine and the engine speed decreased, then the amount of fuel delivered to the engine is increased by an additional modifier.

In one embodiment, this iterative method is repeated by successively modifying the amount of fuel delivered to the engine based upon detected changes in engine speed, whereby the amount of fuel delivered to the engine is optimized based upon a direct indicator of engine performance (and not an indirect indicator such as engine exhaust/emissions content).

The method and system have particular applicability to an engine having a base or OEM engine control unit (ECU) which outputs fuel injector control signals. In accordance with the method, when the engine is operating in one or more modes, such as a Power Mode, the amount of fuel delivered to the engine is optimized, such as by changing the duration of base fuel injector control signals output by the base or OEM ECU.

In one embodiment, the method is effectuated by a secondary ECU which receives the base fuel injector control signals from the base or OEM ECU. The secondary ECU then either passes those signals on to the one or more fuel injectors of the engine or, if the engine is operating in the desired mode, modifies those fuel injector control signals. In this regard, one aspect of the invention is a system comprising a secondary ECU and an engine having a primary ECU and which is modified to include a secondary ECU in accordance with the invention.

A particular advantage of this aspect of the invention is that an engine with an existing OEM ECU can easily be modified to optimize fuel delivery for maximum performance without having to replace or modify the existing OEM ECU and without the need to install different or modified sensors or additional, costly sensors.

Further objects, features, and advantages of the present invention over the prior art will become apparent from the detailed description of the drawings which follows, when considered with the attached figures.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

One embodiment of the invention is a method and system for optimizing fuel delivery to an engine. In one embodiment the method and system have particular applicability to operation of an engine in a Power Mode. Preferably, the method and system of the invention deliver an amount of fuel to an engine to optimize engine speed.

One aspect of the invention is a method and system which modify the operation of an engine which is controlled by an existing original equipment manufacturer (OEM) engine control unit (ECU), and preferably one which controls the amount of fuel delivered to the engine on a closed-loop basis in an emissions/normal operating mode and on an open-loop basis in a Power Mode. In a preferred embodiment of the invention, the method and device modify the amount of fuel which is determined by the OEM ECU to be delivered to the engine so as to optimize engine speed.

Figure 1:
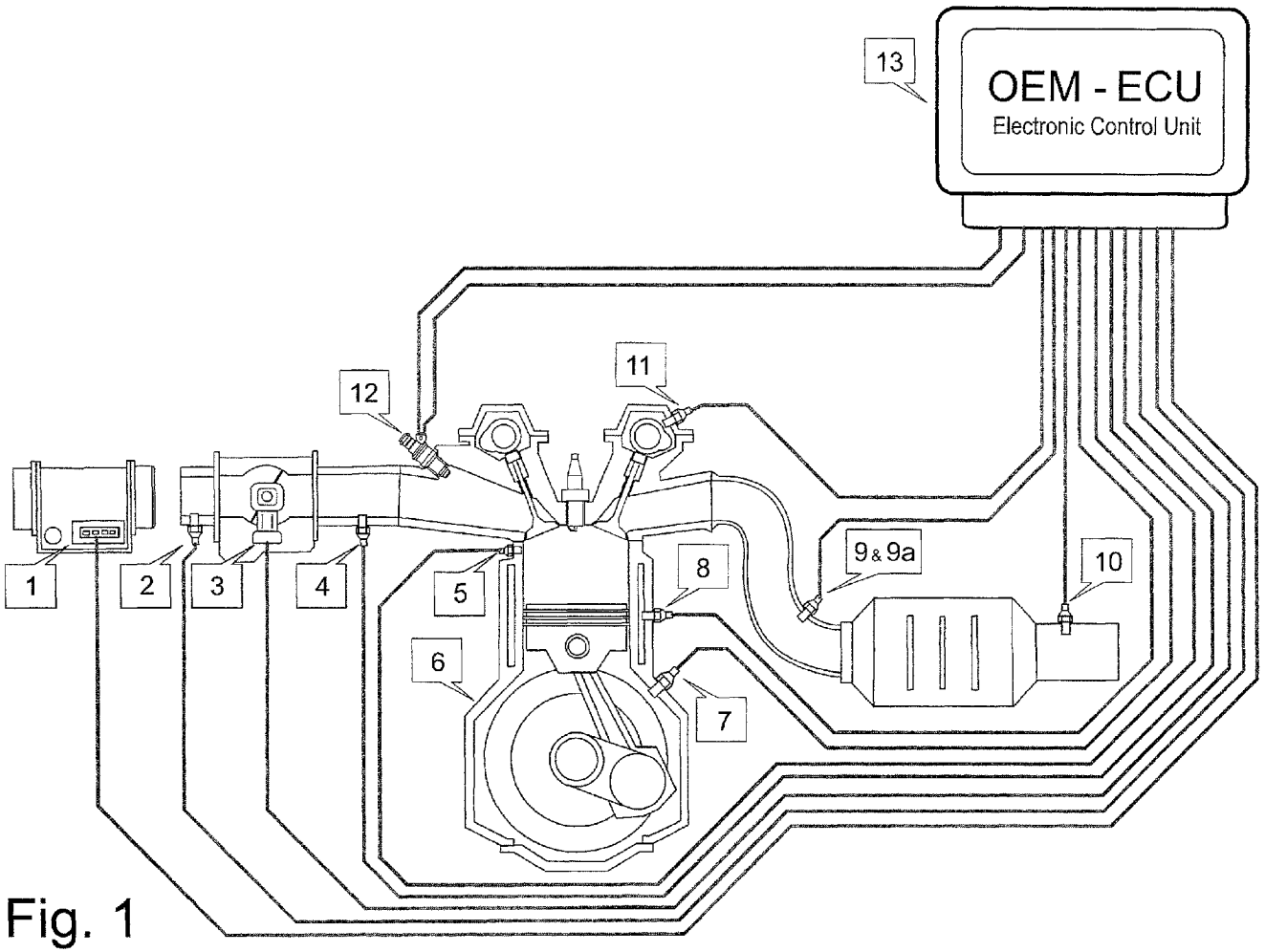
FIG. 1 diagrammatically illustrates an engine and an associated engine control unit in accordance with the prior art.

The method and system of the invention have particular utility to an internal combustion engine. FIG. 1 illustrates one example of an engine to which the invention has applicability. It should be understood that the invention is applicable to other engines.

As illustrated in FIG. 1, an internal combustion engine (6) has at least one variable volume chamber, such as a combustion chamber. At least one member, such as a piston, is preferably movably mounted in or relative to the variable volume chamber. That member, such as piston, may be connected to an output device, such as a crankshaft. As is well known in the art of internal combustion engines, expanding gas in the at least one variable volume chamber preferably effectuates movement of the movable member, such as the piston, which in turn effectuates movement of the output device, such as the crankshaft.

In one embodiment, an engine body may define one or more variable volume chambers or cylinders. A piston may be located in each cylinder. The crankshaft may be located in a crankcase portion of the engine, such as at a bottom of the engine body and enclosed by a crankcase cover.

In a preferred embodiment, fuel is combusted in the at least one variable volume chamber, or expanded gas from such combustion is provided to the at least one variable volume chamber.

In one embodiment, an intake system provides air to each variable volume chamber and a fuel system provides fuel to each variable volume chamber. The intake system may have various features, such as an air inlet leading through one or more filtering devices and then on to one or more passages leading to the variable volume combustion chambers.

The fuel system may be configured to deliver fuel to air passing through the intake system or directly into each variable volume combustion chamber. In a preferred embodiment, the fuel system includes a fuel supply, such as a fuel tank, and one or more delivery lines extending from the fuel tank to at least one fuel delivery device. Such fuel delivery devices preferably comprise one or more electronically controlled fuel injectors. One or more pumps or the like may be used to deliver the fuel from the tank to the fuel injectors and pressurize the fuel for delivery by those injectors.

In addition, the engine preferably includes an exhaust system. The exhaust system preferably comprises at least one exhaust passage leading from each variable volume chamber for routing exhaust from the engine to a remote location. The exhaust system may include other features such as one or more mufflers, a catalytic converter or the like.

It will be appreciated that such engines may have various configurations and be used in a wide variety of settings. For example, the engine may comprise a single cylinder engine or it might have two, four, eight or other numbers of cylinders. Also, the engine might comprise a rotary type engine, as is well known to those of ordinary skill in the art. The engines may operate on various cycles, including two and four cycles. The engines may be gasoline or diesel, and may be used in hybrid systems. Such engines may be used in various applications, such as to power a vehicle such as, but not limited to, a car, truck, boat, off-road vehicle, motorcycle, or the like.

In one embodiment, such an engine may include an engine control system. Such a system may be used to control the engine, such as to control the rate of delivery of air and fuel. As indicated above, the invention has particular utility to an engine having an existing control system which includes an ECU (preferably a primary or base ECU, such as an OEM ECU) and one or more engine condition sensors. As illustrated in FIG. 1, the ECU (13) may obtain feedback information from one or more sensors such as an air mass sensor (1), an intake temperature sensor (2), a throttle position sensor (3), a manifold absolute pressure sensor (4), a vibration anti-knock sensor (5) a crankshaft position sensor (7), an engine temperature sensor (8), a narrow band oxygen sensor (9), a wide band oxygen sensor (9*a*), a post catalytic converter narrow band oxygen sensor (10), and/or a camshaft position sensor (11), and/or other sensors and various combinations of such sensors.

As indicated above, the ECU (13) preferably obtains feedback information from one or more of these sensors and uses such information to control various devices, such as the one or more fuel injectors (12), the position of the throttle or other air flow controller or the like. As indicated above, in one embodiment, the ECU (13) may operate on a closed-loop principle or basis when the engine is in "emissions" mode. For example, the ECU (13) may control the amount of fuel delivered to the engine by the fuel injector(s) (such as by controlling the duration that each fuel injector opens, otherwise known as fuel injector pulse duration) so that the level of emissions as measured by the one or more sensors meet desired emissions levels. The ECU (13) may further be configured to operate in an open-loop basis when the engine is in a Power Mode, such as by the ECU (13) controlling the amount of fuel delivered to the engine during Power Mode as determined by an internal fuel table.

One aspect of the invention is a method of controlling an internal combustion engine, such as the engine described above. In a preferred embodiment, the method comprises optimizing the amount of fuel delivered to the engine, preferably by modifying amount of fuel which a primary ECU indicates is to be delivered to the engine. In one embodiment, the method comprises optimizing fuel delivery when the engine is operating in a Power Mode.

Figure 3:
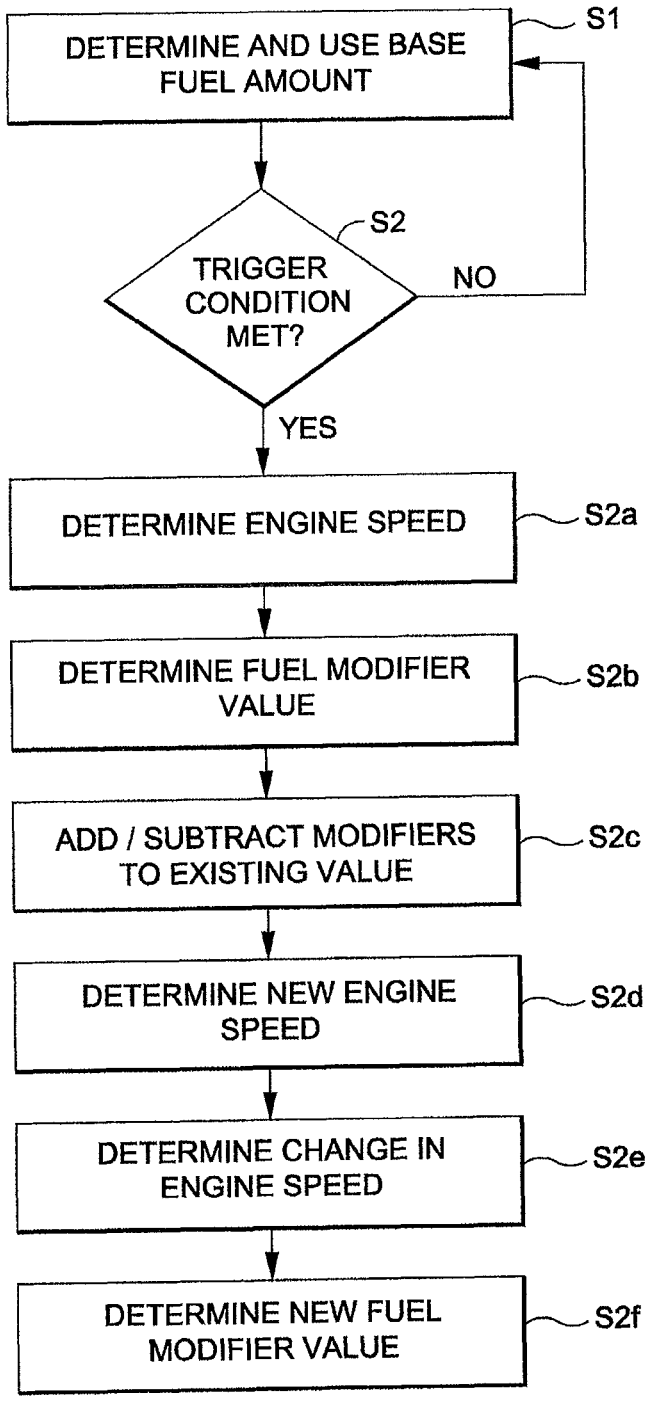
FIG. 3 is a flow chart illustrating a method of engine control in accordance with one embodiment of the invention.

In one embodiment of a method of engine operation as illustrated in FIG. 3, in a first step S1, a primary or OEM ECU determines a quantity of fuel to be delivered to the engine. This quantity of fuel may be determined by feedback information provided by the one or more engine sensors to the ECU and one or more fuel tables or other means of the ECU. When the engine is operating in normal conditions or "emissions" mode, the amount of fuel which the ECU delivers to the engine is preferably selected to ensure that the engine maintains compliance with emissions requirements. The quantity of fuel may be referred to as the base or ECU computed fuel amount or volume. The ECU may output one or more fuel injector control signals having characteristics which correspond to the computed fuel amount or volume, such as fuel injector control signals having a duration or pulse width which cause the fuel injectors to open for a period of time which causes the desired volume of fuel to be delivered to the engine.

In a second step S2, when the engine reaches a selected operating condition, preferably a Power Mode, then the amount of fuel delivered to the engine is optimized in accordance with the optimization method of the present invention. In a preferred embodiment, a determination that the engine has reached the Power Mode operation condition may be determined when the ECU computed fuel amount reaches a triggering value which indicates that the engine is operating in a performance level or Power Mode. In one embodiment, the "triggering" fuel amount may be determined by an injection signal pulse having a certain duration. Of course, other criteria may be used to determine if the engine has reached the desired operating condition.

In accordance with the optimization method, in a step S2*a*, the speed of the engine is determined. In one embodiment, this engine speed is associated with the base or ECU computed fuel amount or volume. For example, the engine speed may simply comprise the measurement of a particular period of time for the engine to complete a portion of an engine cycle, a full engine cycle or the like. The engine speed may thus comprise a "timed cycle", meaning the period of time associated with a particular identified cycle. For example, an engine cycle may comprise the time between successive fuel injection control signals which are output by the primary ECU. However, the engine cycle might comprise a complete rotation of the output shaft, a camshaft, a full piston cycle in a two-cycle engine, a half or full cycle of a piston in a four-cycle engine, or other indicators of actual engine speed.

In a step S2*b*, a fuel modifier value is determined. In one embodiment, the fuel modifier value is preferably an amount of fuel which is relatively small when compared to the current base or ECU computed fuel volume or amount. As detailed below, the fuel modifier may be determined by an external or secondary optimization unit. The fuel modifier value preferably comprises a time value, that time value representing additional time each fuel injector is opened (increased injection duration) or a decrease in the time each fuel injector is opened (decreased injection duration).

In a step S2*c*, the fuel modifier value is either added to or subtracted from the base or ECU computed fuel amount or volume, such as in alternating fashion. The resulting fuel volume after this modification may be referred to as the delivered fuel amount or volume. Again, this value may be represented as a time value, such as the duration of a fuel injector control/actuation signal.

In a step S2*d*, the speed of the engine is determined based upon delivery of fuel in the modified amount. This may comprise determining the amount of time for the engine to complete the same portion of an engine cycle as was determined in step S2*a*. Preferably, as indicated below, the speed of the engine is determined and compared at successive engine cycles.

In a step S2*e*, it is determined whether the fuel modifier resulted in an increase in engine speed (i.e. higher performance) or a decrease in engine speed (i.e. decreased performance). In one embodiment, for example, the engine speed is known to have increased if the time to complete the identified engine cycle decreased.

In a step S2*f*, the amount of fuel which is delivered to the engine is then further modified by a secondary or step fuel modifier amount or volume. In one embodiment: (a) if the fuel modifier increased the amount of fuel delivered to the engine and the engine speed increased, then it is known that the engine requires additional fuel to optimize performance or output; (b) if the fuel modifier increased the amount of fuel delivered to the engine and the speed of the decreased, then it is known that the engine requires less fuel to optimize performance or output; (c) if the fuel modifier decreased the amount of fuel delivered to the engine and the engine speed increased, then it is known that the engine requires less fuel to optimize performance or output; and (d) if the fuel modifier decreased the amount of fuel delivered to the engine and the engine speed decreased, then it is known that the engine requires more fuel to optimize performance or output. In one embodiment, the secondary or step fuel modifier is an amount of fuel which is relatively small compared to the base or ECU fuel delivery amount or volume. The secondary or step fuel modifier is added to or subtracted from the previously calculated delivered fuel amount or volume to create a new delivered fuel amount or volume. That new delivered fuel amount or volume is delivered to the engine and the process repeats to step S2*e* (so long as the engine remains in performance or Power Mode or the other triggering condition is met).

In a preferred embodiment, the method of the invention is implemented by system. In one embodiment, the system comprises at least a secondary engine control unit. The secondary engine control unit is configured to modify the base or ECU determined fuel amount or volume at one or more times.

Figure 2:
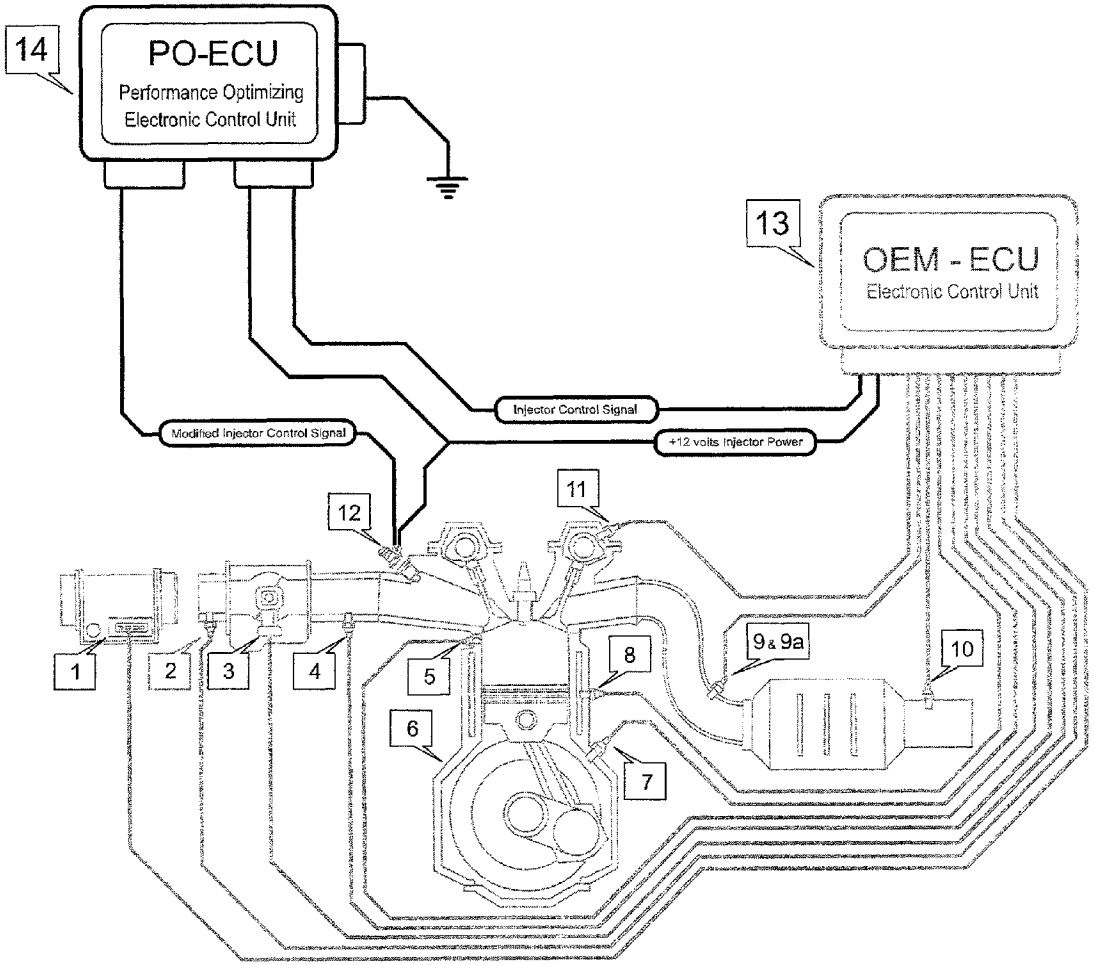
FIG. 2 diagrammatically illustrates an engine and associated control unit as modified in accordance with the present invention.

One example of the system of the invention as applied to an engine is illustrated in FIG. 2. FIG. 2 illustrates the stock engine of FIG. 1, which as described above, includes an OEM ECU (13). As illustrated, the engine also includes a secondary ECU (14). The secondary ECU (14) may have various configurations. In one embodiment, the secondary ECU (14) is an electronically controlled device. The unit may have a processor configured to receive one or more inputs and it may be configured to generate one or more outputs. The processor may comprise hardware which is configured to implement instructions, such as embedded therein or comprising machine readable code (software). The secondary ECU (14) may also comprise one or more data storage or "memory" devices, such as for storing software, fuel tables, engine cycle time information or the like.

In one embodiment, the secondary ECU (14) is configured to intercept and, at one or more times, modify the fuel injector control signal CS which is output by the OEM ECU (13). This may be accomplished, as illustrated, by routing the fuel injector control signal CS output of the OEM ECU (13) to an input of the secondary ECU (14) so that the secondary ECU (14) receives those signals. The secondary ECU (14) then either passes those signals along, or outputs different or modified signals.

Preferably, the secondary ECU (14) is powered. In one embodiment, the secondary ECU (14) is thus connected to a power source, such as a 12V power source and an associated ground.

As indicated above, in a preferred embodiment of the method of the invention, at one or more times, the base or OEM ECU fuel amount or volume is modified. In one embodiment, this modification is performed by changing the duration of the signal or "pulse width" of one or more fuel injectors. When the optimization mode is in effect, the secondary ECU (14) is configured to modify the fuel injector control signal CS which is received from the OEM ECU (13), such as by increasing or decreasing the duration thereof to increase or decrease the fuel amount or volume delivered to the engine. The secondary ECU (14) then provides as an output a modified fuel injector control signal (a modified signal MS) to each fuel injector. This signal then operates each fuel injector in accordance with the desired, modified strategy.

Thus, one aspect of the invention is a method of modifying an engine. Such a method may comprise providing a secondary ECU and installing that secondary ECU in association with an engine, and preferably an engine having a primary ECU. In accordance with the method, the secondary ECU is preferably installed so that a communication link is provided from the primary ECU to the secondary ECU, whereby the fuel injector control signals which are output by the primary ECU are intercepted or received by the secondary ECU. Further, the secondary ECU is placed in communication with the one or more fuel injectors of the engine, whereby fuel injector signals which are output by the secondary ECU, either in pass-through or modified form, control the one or more fuel injectors.

Figure 4:
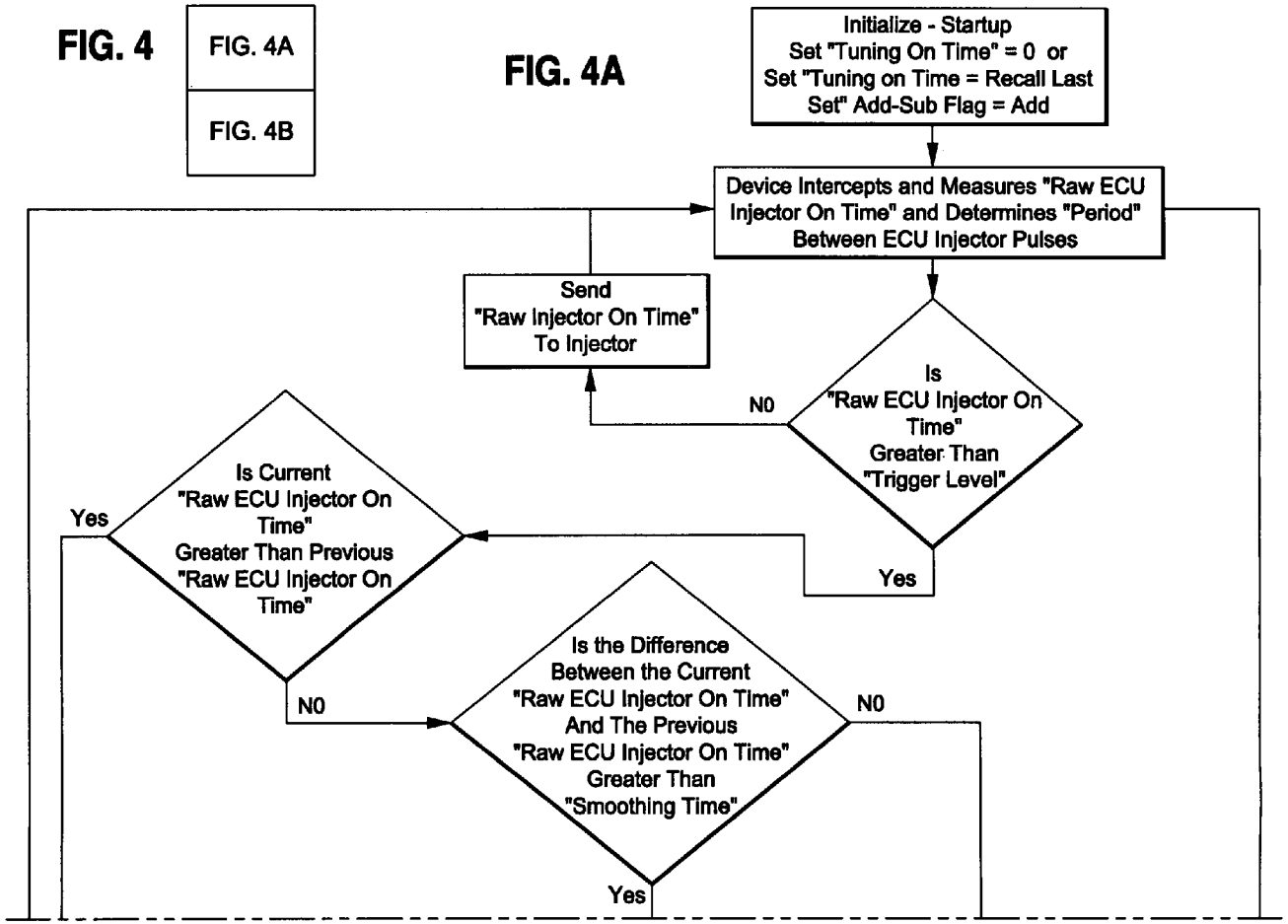
FIGS. 4A and B are combined a flowchart illustrating a method of engine control in accordance with another embodiment of the present invention.

Additional aspects of the method of the invention are illustrated in FIG. 4. FIG. 4 is a flowchart illustrating in greater detail a preferred implementation of the invention. The illustrated method flow may be implemented by, for example, the secondary engine control unit (14) which is associated with the engine illustrated in FIG. 2.

In the flowchart illustrated in FIG. 4, the following terms have the following definitions:

The term PERIOD refers to a measurement of time, preferably that of a complete cycle of an injector signal. In one embodiment, the period is measured from the time an injector is signaled by the ECU to turn on until the next time the ECU signals the injector to turn on. In other embodiments, the period may comprise the period between signals provided from existing or added engine sensors having outputs which relate to engine speed (such as crankshaft or camshaft sensors).

The term TRIGGER LEVEL refers to a predetermined value. In one embodiment, the secondary engine control unit only modifies the fuel delivery when certain selectable criteria are met. If in accordance with the method the secondary engine control unit is not modifying the injector signals, the injector signals from the ECU are passed thru the secondary engine control unit to the injectors. In one embodiment, the TRIGGER LEVEL comprises a predetermined ECU injector signal time (the length of time of the injector "on" signal provided by the ECU). In one embodiment, when that predetermined time is exceeded, the fuel modification method of the invention is activated. The TRIGGER LEVEL can be different for different engines and circumstances with single or multiple conditions required to be met to enable function.

The term INJECTOR PULSE WIDTH SMOOTHING refers to a modified signal and a process of modifying a injector signal. The fuel injector pulse width signals that are output by an OEM ECU are generated using data from various sensors as applied to mathematical formulas and predefined fuel data tables. This process is performed in real-time and is transient in nature. As a result, the injector pulse width signals are constantly changing. Commonly the variance of consecutive injector pulse width signals can be anywhere from 0.25 milliseconds to 0.75 milliseconds. This variance is the combined margin of error of the sensors and methods used in calculating the injector pulse width signals.

To improve the effectiveness of the method of the invention, a smoothing routine may be utilized. Such a routine may be configured to pass through any increase in pulse width without modification as well as any decrease in pulse width which is greater than a selected smoothing value. The routine may be configured so that all decreases in pulse widths that fall in the range of the smoothing value are increased to match the last increasing pulse width value. With this routine a much higher percentage of consecutive periods have matching pulse widths providing increased effectiveness of the method of the invention.

The term RAW ECU INJECTOR ON TIME comprises the duration of the signal generated by the OEM ECU to turn on the injector for a specific period of time based on throttle, sensors and the OEM ECU tables. This factor is the amount of time the injector should open and deliver fuel.

The term SMOOTHING TIME comprises the value which corresponds to the OEM ECU pulse width margin of error.

The term SMOOTHED ECU INJECTOR TIME comprises the smoothed RAW ECU INJECTOR ON TIME.

The term ADD-SUB ON TIME comprises the duration or amount of injector actuation time that is alternately added to or subtracted from the total computed injector actuation time.

The term TUNING ON TIME comprises the amount of time (positive or negative) that is combined with the SMOOTHED ECU INJECTOR TIME to determine the total time an injector is actuated or turned on. Once calculated, this amount of time is increased or decreased by the ADD-SUB ON TIME.

The term TUNED INJECTOR ON TIME comprises the sum of SMOOTHED ECU INJECTOR ON TIME and TUNING ON TIME.

The term ADD-SUB FLAG comprises a flag that indicates whether the ADD-SUB TIME is to be added or subtracted from the total computed injector on time.

The term FINAL INJECTOR ON TIME comprises the sum of TUNED INJECTOR ON TIME, and ADD-SUB ON TIME.

Figure 4B:
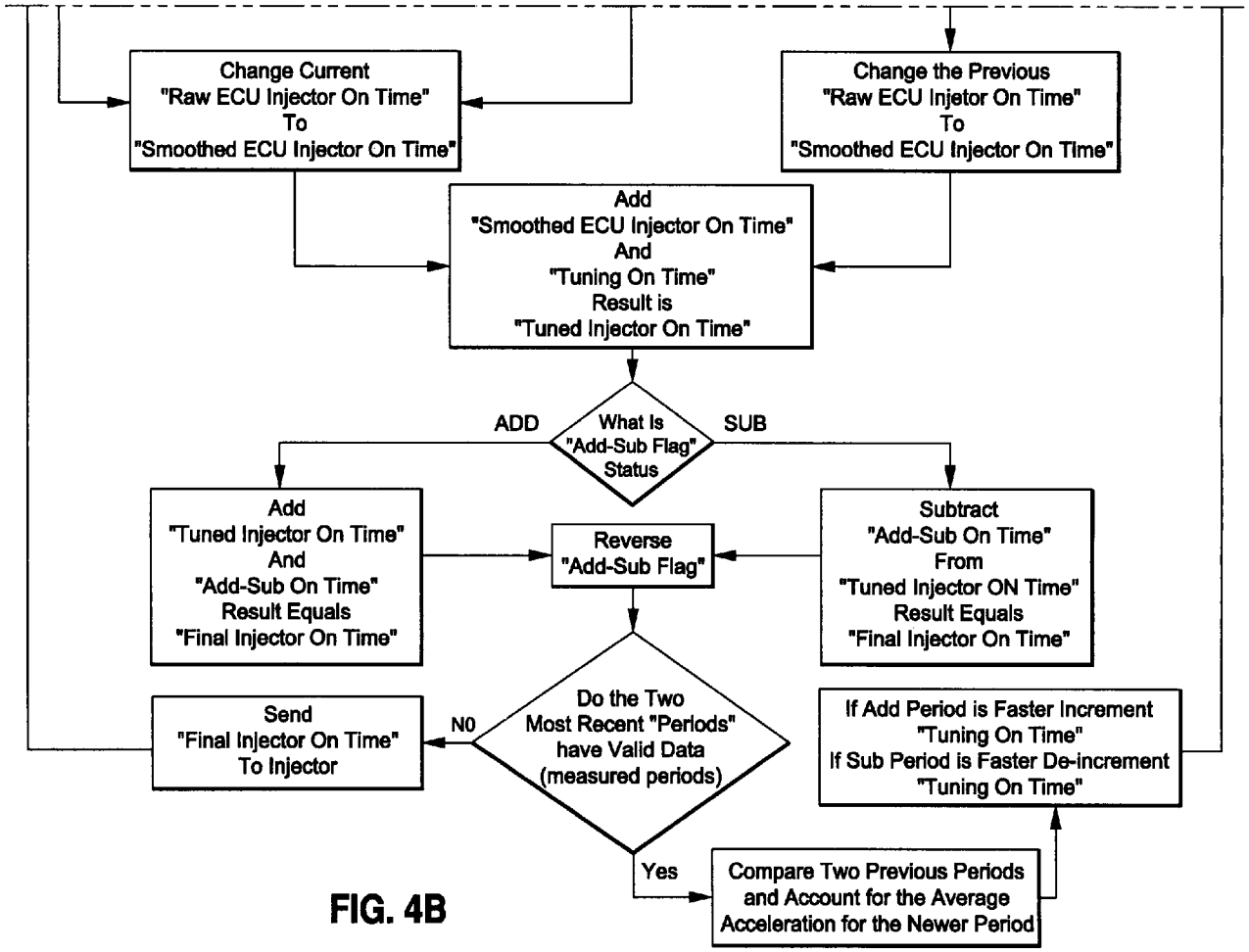

FIGS. 4A and 4B illustrate in more detail a specific implementation of a method of the invention. Of course, the invention might be implemented in other ways.

Various aspects of the invention will now be described in greater detail.

One aspect of the invention is a method and system for optimizing fuel delivery to an internal combustion engine. In a preferred embodiment, fuel delivery is optimized when engine performance, as determined by engine speed, is maximized.

In this regard, an important aspect of the invention is that in accordance with the invention, fuel delivery is controlled, and thus optimized, based upon a direct indicator of performance (engine speed), rather than a secondary indicator of engine performance or a secondary engine condition (such as emissions). In this sense, the optimization method may be referred to as operating on a closed-loop basis (because the rate of fuel delivery is determined by engine speed feedback, unlike the above-described prior art engines which operate in an open-loop basis in Power Mode).

In a preferred embodiment, a method of the invention comprises optimizing fuel delivery of an engine having a base or OEM ECU by modifying the amount of fuel which the OEM ECU indicates is to be delivered to the engine. In one embodiment, this is accomplished by modifying the duration of fuel injector control signals which are output by the OEM ECU.

In a preferred embodiment of the invention, the method is implemented with a secondary ECU which, at one or more times, modifies the fuel injector control or actuation signals which are output by the base or OEM ECU. However, aspects of the invention could be implemented directly by an OEM ECU (such as by creating the OEM ECU in the first instance so that it incorporates one or more aspects of the invention) or by directly modifying an OEM ECU (such as by reprogramming the OEM ECU so that it is capable of implementing one or more aspects of the invention, such as by modifying the OEM ECU to include a sub-routine or additional program feature which modifies the output of the primary OEM ECU code to implement the invention).

As indicated, in a preferred embodiment, the optimization method involves incrementally changing the amount of fuel delivered to the engine (preferably by increasing or decreasing the duration of a fuel injector actuation signal) based upon engine speed feedback. In a preferred embodiment, each injector control signal may be modified. However, it is possible to modify every other control signal provided to a fuel injector, every third signal or the like. In such event, a first control signal provided to one or more fuel injectors may be modified and then the change in engine speed may be monitored over a period of several injector signals. Based upon the change in engine speed, the third, fourth or other later injector signal may then be re-modified. It will be appreciated, however, that the process of modifying each and every signal based upon detected changes in engine speed between adjacent signals, results in the fastest and most accurate fuel delivery optimization.

As indicated, in accordance with the invention a fuel delivery amount (such as from a base ECU) is modified. The amount of the modification may vary. As indicated, in one embodiment, the initial modification value may be a relatively small percentage of the base amount. For example, if the duration of the base fuel injector control signal is X, the modification value may be 0.05X to around 0.1X. Of course, other amounts of modification may be utilized, and those modification values may vary.

The method and system of the invention may have other configurations, including other features. For example, as indicated in the embodiment illustrated in FIG. 4, a smoothing routine or other optimization may be performed to modify the fuel injector control signals output by the base ECU to remove certain margins of error, thus resulting in more effective optimization of those signals.

In one embodiment, the method and system may be configured to mitigate the effect of the overall acceleration rate of the engine on the optimization calculations, such as by determining the average acceleration of the measured cycles and using such a value to minimize the effect of the overall acceleration rate on the optimization calculations.

In one embodiment, the method and system may be configured to mitigation the effect of various environmental variables from the optimization calculations. In one embodiment, changes in environmental conditions upon engine operation may be mitigated by comparing each timed cycle with its next consecutive timed cycle (whereby under normal conditions, each time cycle is only milliseconds apart, such that the change of any environmental factors would be too slow to effect engine operations during such a short period of time).

A particular advantage of the invention, particularly the aspect of using a secondary ECU, is that the method of the invention can be applied to existing engines having an OEM ECU at little cost and with little required modification. In particular, millions of existing vehicles have an internal combustion engine having an OEM ECU which is configured to operate in a closed-loop emissions mode during normal operation and in an open-loop configuration in a Power Mode. In accordance with the invention, fuel delivery may be optimized in such engines (thus optimizing engine power/performance), merely by adding the secondary ECU as indicated above. Notably, the system of the invention requires only that the secondary ECU be interfaced to intercept the base fuel injector control signals which are output from the OEM ECU. The system does not require the installation of different or modified sensors or additional sensors. In addition, the system of the invention does not require the base or OEM ECU to be replaced or modified. In this regard, while the invention utilizes a secondary ECU, this ECU has functionality limited to the specific fuel delivery aspects noted above, while an OEM ECU typically has a great deal of functionality and performance relating to a wide range of engine functions and controls. Thus, the cost and complexity of a base or OEM ECU is generally magnitudes greater than the secondary ECU herein, whereby use of the secondary ECU results in substantial cost savings over creating a completely new or modified base ECU having such functionality.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A method of optimizing fuel delivery to an internal combustion engine having a base engine control unit comprising the steps of:

(a) monitoring fuel injector controls signals output by said base engine control unit, said fuel injector control signals having a duration;

(b) determining if the engine is operating in a designated condition;

if said engine is operating in said designated condition:

(c) modifying an amount of fuel delivered to said engine by either increasing or decreasing a duration of at least one of said fuel injector control signals output by said base engine control unit to a modified duration;

(d) determining if a speed of said engine increased or decreased in response to said modification of said amount of fuel delivered to said engine; and (e) if said speed of said engine increased and said duration was increased, further increasing said modified duration and if said duration was decreased, further decreasing said modified duration;

(f) if said speed of said engine decreased and said duration was increased, decreasing said modified duration, and if said duration was decreased, increasing said modified duration; and (g) repeating steps (d)-(f) one or more times.

2. The method in accordance with claim 1 wherein said designated condition comprises a power mode.

3. The method in accordance with claim 1 wherein said designated condition comprises an open-loop control mode of said base engine control unit.

4. A method of optimizing engine performance of a fuel-injected internal combustion engine having at least one engine control unit which operates said engine in at least an emissions mode and a power mode, comprising the steps of:

(a) utilizing emissions-mode fuel injector controls signals generated by said at least one engine control unit when said engine is in said emissions mode, said emissions-mode fuel injector control signals having a duration;

(b) determining if said engine is operating in a power mode during which said at least one engine control unit generates base power mode fuel injector control signals, and if so:

(c) modifying an amount of fuel delivered to said engine by either increasing or decreasing a duration of at least one of said base power mode fuel injector control signals generated by said at least one engine control unit to a modified duration;

(d) determining if a speed of said engine increased or decreased in response to said modification of said amount of fuel delivered to said engine; and (e) if said speed of said engine increased and said duration was increased, further increasing said modified duration and if said duration was decreased, further decreasing said modified duration;

(f) if said speed of said engine decreased and said duration was increased, decreasing said modified duration, and if said duration was decreased, increasing said modified duration; and (g) repeating steps (d)-(f) one or more times.

5. The method in accordance with claim 4 wherein said emissions mode comprises a closed-loop mode.

6. The method in accordance with claim 5 wherein said engine includes one or more emissions sensors and said closed-loop mode comprises generating base emissions mode fuel injector control signal based upon feedback from said one or more sensors.

7. The method in accordance with claim 4 wherein said power mode comprises an open-loop mode.

8. The method in accordance with claim 4 wherein said step of modifying comprises intercepting a signal output by said at least one engine control unit and modifying said signal with at least one secondary engine control unit.

9. The met hod in accordance with claim 4 wherein said at least one engine control unit comprises a single base engine control unit and said steps are performed by said single base engine control unit.

10. A modified internal combustion engine comprising:

an internal combustion engine having at least one variable volume chamber;

at least one fuel injector configured to deliver fuel into air for combustion in said at least one variable volume chamber of said engine;

at least one sensor configured to output a signal regarding a measured condition of said engine;

a base ECU configured to receive said signal from said at least one sensor, said base ECU configured to output at least one first fuel injector control signal to said at least one fuel injector in a closed-loop mode when said engine is operating in an emissions condition and configured to output at least one second fuel injector control signal to said at least one fuel injector in an open-loop mode when said engine is operating in a power condition; and a secondary ECU configured to intercept said fuel injector control signals output from said base ECU and pass said at least one first fuel injector control signal to said at least one fuel injector when said engine is operating in said emissions condition and to modify said at least one second fuel injector control signal when said engine is operating in said power condition, said secondary ECU configured to modify said at least one second fuel injector control signal by increasing or decreasing a duration thereof to optimize delivery of fuel to said engine.

11. The modified internal combustion engine in accordance with claim 10, wherein said secondary ECU is configured to:

(a) modify an amount of fuel delivered to said engine by either increasing or decreasing a duration of said at least one second fuel injector control signal to a modified duration;

(b) determine if a speed of said engine increased or decreased in response to said modification of said amount of fuel delivered to said engine; and (c) if said speed of said engine increased and said duration was increased, further increase said modified duration and if said duration was decreased, further decrease said modified duration;

(d) if said speed of said engine decreased and said duration was increased, decrease said modified duration, and if said duration was decreased, increase said modified duration; and (e) repeat steps (b)-(d) one or more times.

* * * * *